US008132582B2

(12) United States Patent
Goebel

(10) Patent No.: US 8,132,582 B2
(45) Date of Patent: Mar. 13, 2012

(54) UMBRELLA WITH TWO BELTS

(75) Inventor: Felix Goebel, Ulm (DE)

(73) Assignee: Eberhard Goebel GmbH & Co., Ulm (DE)

( * ) Notice: Subject to any disclaimer, the term of this patent is extended or adjusted under 35 U.S.C. 154(b) by 0 days.

(21) Appl. No.: 12/828,322

(22) Filed: Aug. 12, 2010

(65) Prior Publication Data

US 2012/0037195 A1 Feb. 16, 2012

(51) Int. Cl.
*A45B 11/02* (2006.01)

(52) U.S. Cl. ..... 135/16; 224/188

(58) Field of Classification Search ..... 135/16, 135/25.4; 224/188, 190
See application file for complete search history.

(56) References Cited

U.S. PATENT DOCUMENTS

| | | | | | |
|---|---|---|---|---|---|
| 191,782 | A * | 6/1877 | Smith, Sr. | ..... | 224/190 |
| 1,041,577 | A * | 10/1912 | Bekkevar | ..... | 224/190 |
| 2,085,984 | A * | 7/1937 | Kruithof | ..... | 224/188 |
| 2,541,614 | A * | 2/1951 | Rosenberger | ..... | 224/188 |
| 2,610,778 | A * | 9/1952 | Young | ..... | 224/188 |
| 3,282,482 | A * | 11/1966 | Scharsu | ..... | 224/605 |
| 4,537,339 | A * | 8/1985 | Pearson | ..... | 224/188 |
| 4,739,914 | A * | 4/1988 | Pothetes | ..... | 224/673 |
| 4,883,290 | A * | 11/1989 | Landa | ..... | 280/814 |
| 5,513,786 | A * | 5/1996 | Drane | ..... | 224/188 |
| 5,918,612 | A * | 7/1999 | Hughes | ..... | 135/16 |
| 6,024,464 | A * | 2/2000 | De Vera | ..... | 362/102 |
| 6,520,192 | B1 * | 2/2003 | Lo | ..... | 135/25.4 |
| 6,866,173 | B2 * | 3/2005 | Haber | ..... | 224/160 |
| 7,275,668 | B1 * | 10/2007 | Carroll | ..... | 224/190 |
| 2001/0035202 | A1 * | 11/2001 | Moskowitz et al. | ..... | 135/16 |

* cited by examiner

*Primary Examiner* — Noah Chandler Hawk
(74) *Attorney, Agent, or Firm* — Andrew Wilford

(57) ABSTRACT

An umbrella having a telescopic shaft having one end carrying a handle and an opposite end carrying a canopy is held in a harness having upper and lower belts fittable on a user. The handle is secured to the lower belt. A strap around the upper belt carries a clip having a base plate and a counter plate flanking the strap, a pivot pin passing through the strap between the base plate and counter plate, and four fingers projecting from the base plate and releasably gripping the umbrella shaft.

14 Claims, 9 Drawing Sheets

UMBRELLA WITH TWO BELTS

FIELD OF THE INVENTION

The invention is the combination of an umbrella, in particular for rain or sun, with at least two belts fittable to the body of a user, comprising, with respect to the umbrella, a telescopic umbrella shaft with a handle arranged on the shaft's free ends selected to interact with one of the belts, and a canopy, and with respect to the belts at least one rotatably mounted clip for reversibly receiving the umbrella shaft.

BACKGROUND OF THE INVENTION

U.S. Pat. No. 6,866,173 describes an umbrella whose handle has a closed ring and through which a lap belt of a backpack or a child carrier can be guided so as to attach the free, axially lower end of the umbrella shaft on the body of the user. At an axial spacing from the ring, the umbrella shaft can be attached by a hook-and-loop fastener on the shoulder belt of the backpack or the child carrier so that the umbrella protects the user without the user having to permanently keep at least one hand free. In practice, such an umbrella could not yet establish itself on the market because the it has disadvantages that considerably limit the usability because in contrast to an umbrella held in the hand, it is not possible to adapt the orientation of the umbrella to real conditions. If the rain does not fall vertically from above onto the user due to strong or gusty winds, the user can not tilt the umbrella accordingly to achieve an optimal protection. The protection provided by the umbrella falls far behind with respect to the actually achievable protection and compared to an umbrella guided in the hand and inclined into the falling rain.

OBJECT OF THE INVENTION

The object of the invention is thus to configure a combination in such a manner that the disadvantages mentioned above are overcome.

SUMMARY OF THE INVENTION

In the prior art, the umbrella shaft is attached to the carrying belt by a hook-and-loop strip. The extension of the loop of the hook-and-loop strip allows variation of the inclination of the umbrella shaft; however, this resulted in that the umbrella shaft can wobble back and forth within the loop and can disturb or even hurt the user during gusty winds. The invention avoids excessive movability of the umbrella shaft also in its inclined position by securely receiving the umbrella shaft in a clip. Of course, for this purpose, the longitudinal extension of the clip has to be aligned parallel to the umbrella shaft such that the desired variable inclination is achieved by the rotatable support of the clip.

This increased variability when positioning the umbrella shaft on the body of the user makes it possible to greatly vary the specific arrangement of the attachment points and in particular to avoid exclusively using the belts of a backpack guided across the front of the user's body. Thus, within the scope of the invention there it is also possible to use the combination according to the invention detached from a backpack by providing closures for closing at least one of the belts, preferably both belts, into an annulus and guiding the belts therewith as anchor supports for the handle and the clip preferably around the upper body of the user.

Of course, it is also possible that at least one of the belts, preferably both belts, form a strap supporting a load carried on the body of the user, which load can also form a bag as is the case for a backpack.

In particular if the clip is pivoted on a belt strap that can be fastened to one of the belts, it is possible to use the umbrella as part of the combination with different belts because via the belt strap as carrier of the pivotal clip it is possible to use the clip on different belts. Thus, the user has the possibility, for example, of using the umbrella on one day as a rain shield on a backpack, whereas for hiking on a sunny day, the umbrella can be allocated to a child carrier frame. Thus, not each is carrying strap of a backpack or carrier frame must be provided with a clip provided for the combination. Overall, this results in a great variability with respect to the attachment of the umbrella because it can be attached on the front and the back of the user's body as well as on a side.

The reversible attachment of the belt strap on one of the belts is achieved in a simple manner in that the belt strap has a hook-and-loop fastener.

Within the scope of the invention it is particularly preferred if the clip is integrally formed with a base plate from which four elastic fingers project as opposing pairs, and if the base plate has a pivot pin that projects through the belt strap and to which a counter plate is attached. Thus, the belt strap is engaged on both sides in the area of the clip by the base plate, and thus a rigid, stable area is formed by means of which, without a twist or torsion of the belt, the force applied by the umbrella shaft can be transferred with minor surface pressure into the belt.

It is further advantageous if the handle has a belt loop for passing through the belt, and the belt holder does not have to be a closed ring but can be an elastically pre-tensioned buckle.

It is another object of the invention to offer the user the possibility of adapting, in particular aligning, the umbrella in a manner as variable as possible with respect to current environmental conditions. It is thus preferred that the telescopic umbrella shaft has a plurality of latching seats for variably locking its length. This provides in particular the possibility of adapting the length of the umbrella shaft to the length of the upper body or size of the user, that otherwise, in case of hand-held umbrellas, is performed automatically by the user's own hand or arm position.

Alternatively or additionally it is also possible that the telescopic umbrella shaft has a clip for variably locking its length, a continuous length change being and not specific steps as in the case of the latch seats.

BRIEF DESCRIPTION OF THE DRAWING

The invention is explained herebelow in more detail with reference to embodiments illustrated in the drawing; therein.

DETAILED DESCRIPTION

Figure 1:
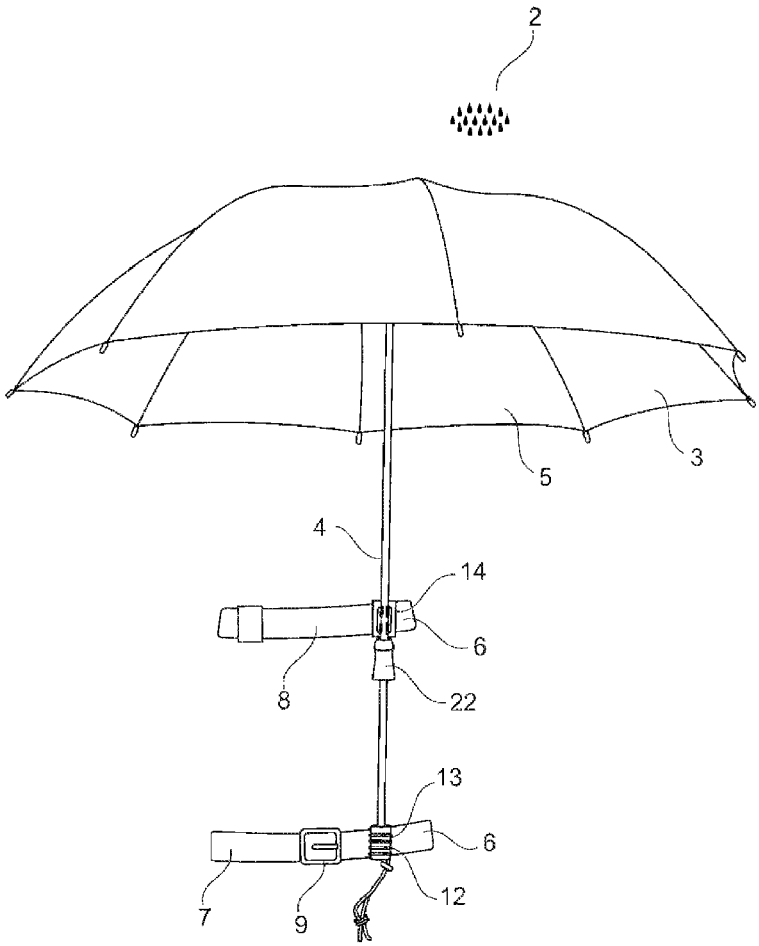
FIG. 1 shows a first embodiment of a combination according to the invention, attached on the upper body of a user by two belts, with the umbrella open.
Figure 2:
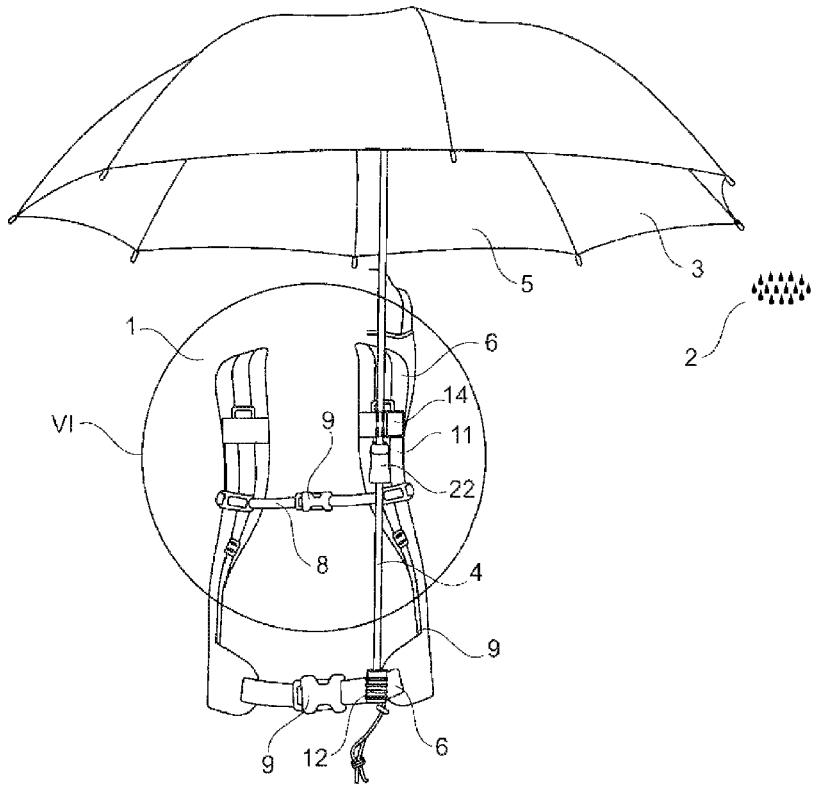
FIG. 2 is a view like FIG. 1 of a further embodiment with belts formed by a lap belt and shoulder belt of a backpack.
Figure 3:
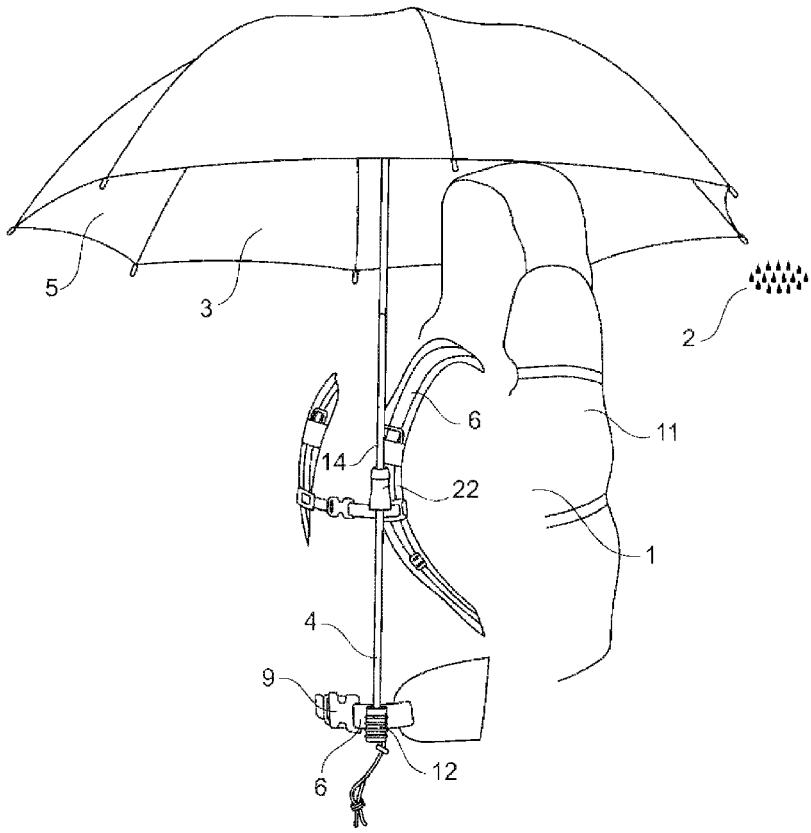
FIG. 3 is a perspective view of the structure of FIG. 2.
Figure 4:
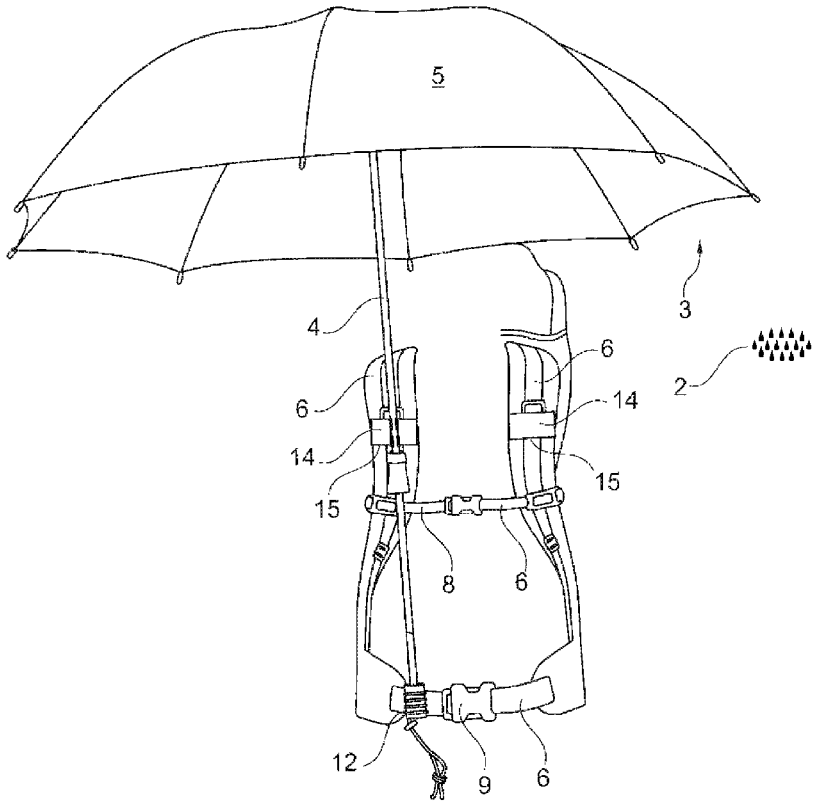
FIG. 4 is a view like to FIG. 2 with the umbrella attached on the right side of the user.
Figure 5:
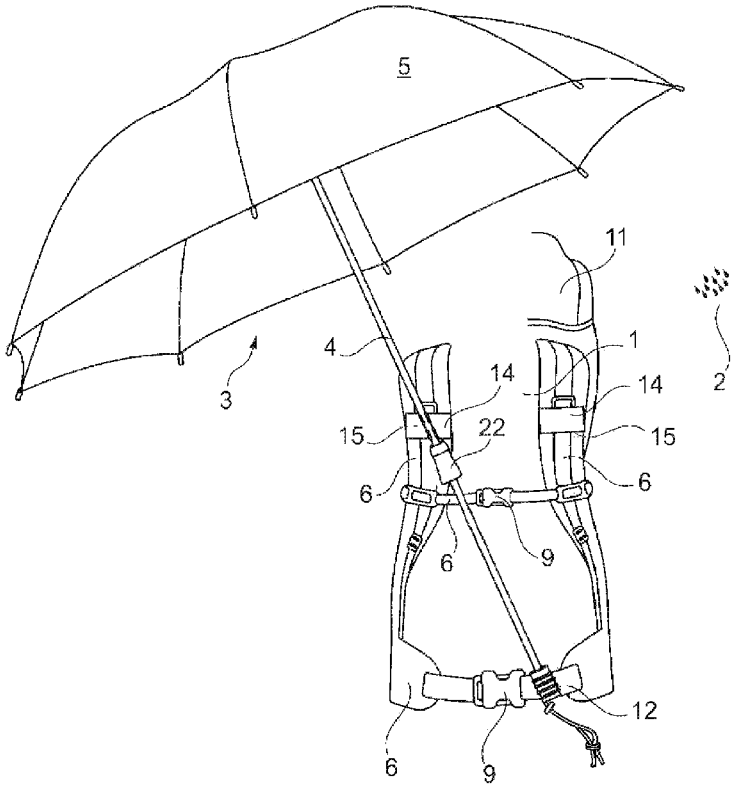
FIG. 5 is a view like FIG. 4 with the umbrella angled into the rainfall.

In the drawing, a user 1 is shown who needs protection against rain 2. The protection is provided without the need of the hands of the user 1 in that an umbrella 3 is provided, in the illustrated embodiment as shown in FIG. 1 an umbrella that comprises in a typical manner a telescopic shaft 4 and a canopy 5. This umbrella 3 is combined with two belts 6 fitted to the body of the user 1, one of the belts being a waist belt 7 and the other a chest belt 8. Both belts 7 have closures 9 for closing into an annulus so that the belts 6 can be put around the body of the user 1 and fixed by the closures 9. Within the scope of the invention it is, of course, also possible that the belts 6 are formed by the straps of a load, in particular a backpack 11, carried on the body of the user 1 (FIG. 2, FIG. 3).

Figure 6:
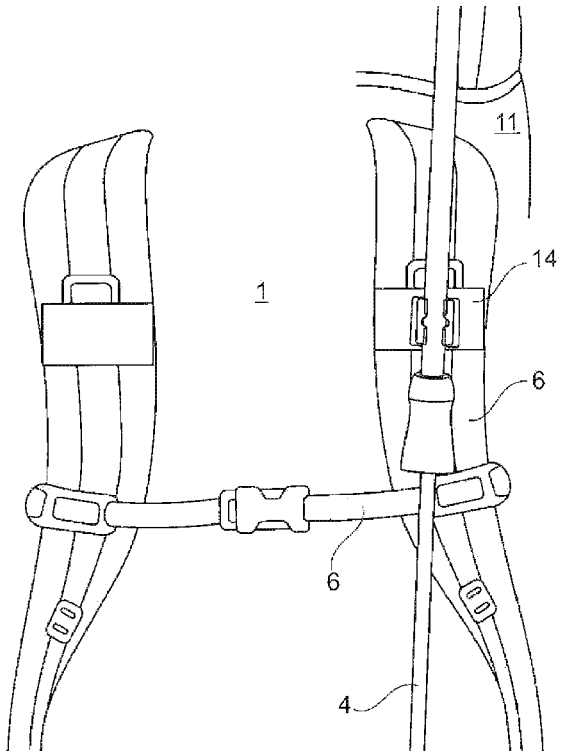
FIG. 6 shows detail VI of FIG. 2.
Figure 7:
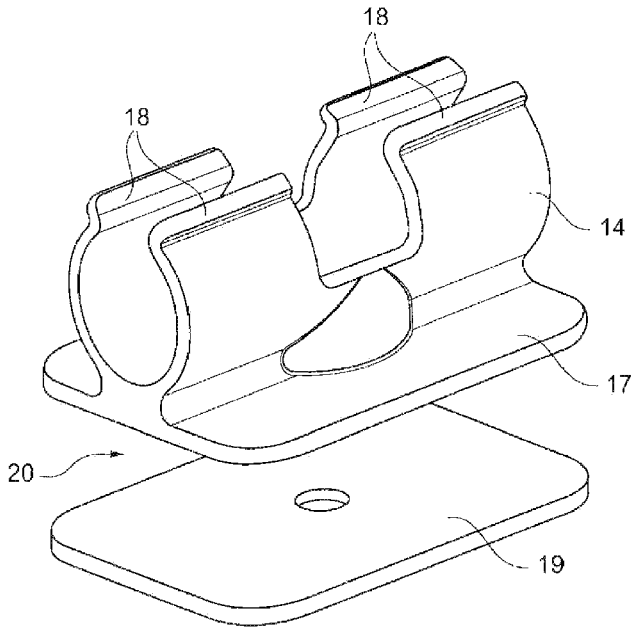
FIG. 7 is an exploded view of the clip according to the invention.
Figure 8:
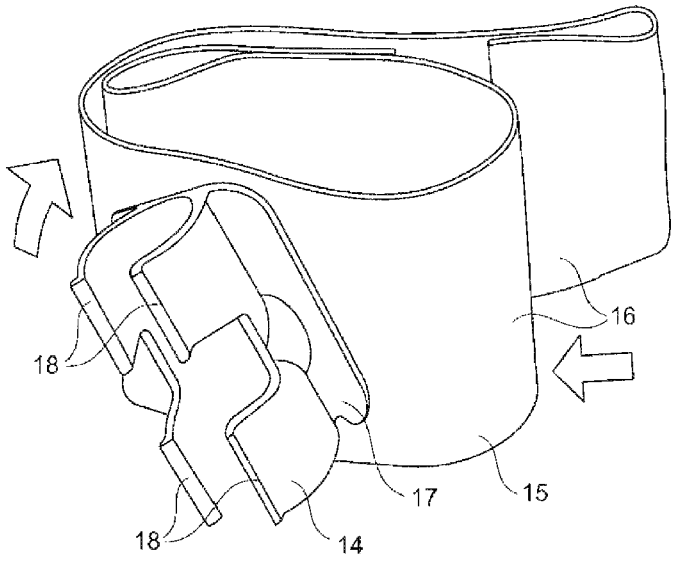
FIG. 8 is a perspective view of the clip rotatably mounted on the belt strap.
Figure 9:
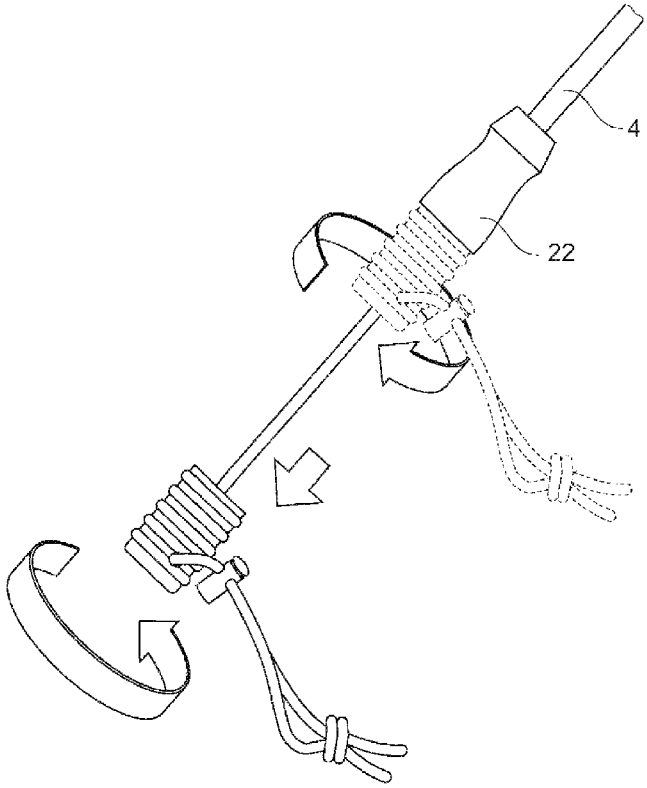
FIG. 9 is a schematic view for illustrating the grip.

An umbrella handle 12 on one free end of the umbrella shaft 4 is configured in such a manner that it can fit with one of the belts 6, in particular the lower lap belt, this being ensured in the embodiment illustrated in the drawing by a belt loop 13. Furthermore, with respect to the belts 6, the combination comprises at least one pivotal clip 14 for reversibly receiving the umbrella shaft 4, which clip is shown in detail in FIGS. 6 to 8. The clip 14 is pivoted on a strap 15 that can be attached to one of the belts 6 and that has a hook-and-loop fastener 16. The clip 14 itself is integrally formed with a base plate 17 from which four elastic fingers 18 project as opposing pairs. The base plate 17 has a pivot pin 20 that projects through the belt strap 15 to a counter plate 19. The base plate 17 and counter plate receive the belt strap 15 between them to form a stable, rigid base resting on the belt 6.

The combination according to the invention can be worn on the body of the user 1 in a very variable manner, namely on the front as well as the back of the user, right and left of the body axis, or in an arrangement inclined to the body axis so that the incidence angle of the rain 2 under the influence of wind can be considered. In case of a parasol it is possible to allow for the current position of the sun or, in case of a prolonged hike, to allow for the course of the sun. The variable adaptation to the circumstances depending on environmental conditions or the user is additionally improved in that the telescopic umbrella shaft 4 has a plurality of axially spaced latching seats for variably locking the length of the shaft so that the user 1 can in particular adjust how far above his head the canopy 5 is positioned. There is also the possibility of using a grip 22 for locking the length of the umbrella shaft 4.

The invention claimed is:

1. In combination:

an umbrella having a telescopic shaft having one end carrying a handle and an opposite end carrying a canopy;

two belts fittable on a user;

means for securing the handle to one of the belts;

a strap around the other of the belts; and a clip having a base plate and a counter plate flanking and fixed to the strap and four fingers projecting from the base plate and releasably gripping the umbrella shaft.

2. The combination according to claim 1, wherein at least one of the belts is provided with a closure for closing the belt into an annulus.

3. The combination according to claim 2, wherein at least one of the belts supports a load carried on the body of the user.

4. The combination according to claim 3, wherein the load is a bag.

5. The combination according to claim 1, wherein the strap has a hook-and-loop fastener.

6. The combination according to claim 1 wherein the clip includes a pivot pin passing through the strap and seated in the counter plate.

7. The combination according to claim 1 wherein the handle has a belt loop through which one of the belts passes.

8. In combination, an umbrella having an axially telescopic shaft having opposite ends, a handle at one of the ends, and an openable and closable canopy at the other of the ends, and a belt harness fittable to a wearer of the combination and having an upper belt;

a base plate;

a counter plate;

a strap for releasably securing the plates on the upper belt and passing between the plates, a pin passing through the plates and through the strap and fixing the plates to the strap;

elastic fingers on the base plate and capable of gripping the shaft between its ends, a lower belt, and means releasably securing the handle to the lower belt.

9. The combination defined in claim 8 wherein the lower belt is a waist belt encircling a waist region of the wearer.

10. The combination defined in claim 9 wherein the means releasably securing the handle to the lower belt is a loop on the handle and through which the lower belt passes.

11. The combination defined in claim 9 wherein the upper belt is attached to and extends vertically upward from the waist belt and over a shoulder of the wearer.

12. The combination defined in claim 8 wherein the means for securing the support to the upper belt includes a strap wrappable around the upper belt and a hook-and-loop fastener for closing the strap around the upper belt.

13. The combination defined in claim 8 wherein the harness is part of a backpack.

14. In combination:

an umbrella having a telescopic shaft having one end carrying a handle and an opposite end carrying a canopy;

upper and lower belts fittable on a user;

means for securing the handle to the lower belt;

a strap around the upper belt; and a clip having a base plate and a counter plate flanking the strap, a pivot pin passing through the strap between the base plate and counter plate, and four fingers projecting from the base plate and releasably gripping the umbrella shaft.

* * * * *